US005212891A

United States Patent [19]

Schuermann et al.

[11] Patent Number: 5,212,891

[45] Date of Patent: May 25, 1993

[54] SOFT EXCAVATOR

[75] Inventors: Kenneth W. Schuermann; James E. Franklin; Arthur D. Deken, all of Perry, Okla.

[73] Assignee: The Charles Machine Works, Inc., Perry, Okla.

[21] Appl. No.: 646,150

[22] Filed: Jan. 25, 1991

[51] Int. Cl.[5] ..... E02F 3/88

[52] U.S. Cl. ..... 37/62; 241/1; 241/301; 37/63; 299/17; 406/88; 406/153

[58] Field of Search ..... 37/61, 62, 63, 78, 79, 37/59, 80 R; 241/1, 301; 299/17; 175/66, 424, 324, 213; 406/88, 96, 162, 157, 153, 113, 38

[56] References Cited

U.S. PATENT DOCUMENTS

| | | | |
|---|---|---|---|
| 601,527 | 3/1898 | Melcher | 37/62 |
| 811,275 | 1/1906 | Cole | 37/62 |
| 823,749 | 6/1906 | Wanner | 175/67 |
| 842,364 | 1/1907 | White | 37/61 |
| 967,797 | 8/1910 | Lovett | 37/62 |
| 1,180,664 | 4/1916 | Littlehaus | 37/62 |
| 1,493,651 | 5/1924 | Swenson | 37/62 |
| 1,778,942 | 10/1930 | Harp . | |
| 1,994,884 | 3/1935 | Chew . | |
| 2,061,032 | 11/1936 | Huff . | |
| 2,121,858 | 9/1937 | Chew . | |
| 2,125,740 | 8/1948 | Schacht . | |
| 2,475,832 | 7/1949 | Gilliland . | |
| 2,518,591 | 8/1950 | Aston et al. . | |
| 2,599,980 | 6/1952 | Dunning | 37/62 |
| 2,711,598 | 6/1955 | Coraggs, J r. | 37/62 |
| 2,923,959 | 2/1960 | Huber . | |
| 3,219,394 | 11/1965 | Moss et al. . | |
| 3,262,318 | 7/1966 | Decker . | |
| 3,301,606 | 1/1967 | Bruno . | |
| 3,436,125 | 4/1969 | Doherty et al. . | |
| 3,444,584 | 5/1969 | Cote . | |
| 3,512,841 | 5/1969 | Kollasch et al. . | |
| 3,545,886 | 12/1970 | Chalom . | |
| 3,585,740 | 6/1971 | De Koning . | |
| 3,672,790 | 6/1972 | White . | |
| 3,674,100 | 7/1972 | Becker . | |
| 3,678,534 | 7/1972 | Hilbig . | |
| 3,839,875 | 10/1974 | Matsushita . | |
| 3,858,398 | 1/1975 | Van Weele | 37/78 |
| 3,916,634 | 11/1975 | Woodruff . | |
| 3,922,753 | 12/1975 | Aberilla . | |
| 3,930,324 | 1/1976 | Wightman et al. . | |
| 3,967,341 | 7/1976 | Gavin . | |
| 3,971,096 | 7/1976 | Renholt . | |
| 4,018,483 | 4/1977 | Smith . | |
| 4,055,870 | 11/1977 | Furutsutsumi . | |
| 4,084,648 | 4/1978 | Yahiro et al. . | |
| 4,087,981 | 5/1978 | Norman . | |
| 4,123,858 | 11/1978 | Batchelder . | |
| 4,227,863 | 10/1980 | Sommerer . | |
| 4,240,173 | 12/1980 | Sherrill . | |

(List continued on next page.)

FOREIGN PATENT DOCUMENTS

| | | |
|---|---|---|
| 264556 | 2/1964 | Australia . |
| 434012 | 12/1969 | Australia . |
| 492972 | 6/1976 | Australia . |
| 0251660 | 6/1987 | European Pat. Off. . |
| 1378637 | 12/1974 | United Kingdom . |

OTHER PUBLICATIONS

Excerpts from the text "Fundamentals of Gas Turbines" by Bathie, pp. 1–17 and pp. 43–62.

Excerpts from the text "Fundamentals of Classical (List continued on next page.)

*Primary Examiner*—Dennis L. Taylor
*Assistant Examiner*—Spencer Warnick
*Attorney, Agent, or Firm*—Richards, Medlock & Andrews

[57] ABSTRACT

A soft excavator (10, 90, 110, 130) is disclosed which utilizes a jet of high velocity fluid flow such as air or water flow, preferably supersonic, through a nozzle (48, 92, 112) to excavate a material, such as the ground. A second passage for air flow is provided which is directed by an evacuator skirt (52, 102) in a direction along the excavator generally opposite the direction of discharge of the high velocity excavating flow to entrain the material excavated for disposal.

17 Claims, 9 Drawing Sheets

U.S. PATENT DOCUMENTS

| | | | |
|---|---|---|---|
| 4,264,212 | 4/1981 | Tookey . | |
| 4,319,784 | 3/1982 | Claringbull . | |
| 4,322,897 | 4/1982 | Brassfield . | |
| 4,400,138 | 8/1983 | Baer . | |
| 4,409,746 | 10/1983 | Beck . | |
| 4,420,187 | 12/1983 | Hodges | 299/17 |
| 4,437,525 | 3/1984 | O'Hanlon . | |
| 4,479,741 | 10/1984 | Berti et al. . | |
| 4,487,553 | 12/1984 | Nagata . | |
| 4,497,519 | 2/1985 | Grable . | |
| 4,562,612 | 1/1986 | Williams et al. . | |
| 4,585,274 | 4/1986 | Grable . | |
| 4,760,656 | 8/1988 | East | 37/62 |
| 4,776,731 | 10/1988 | Briggs et al. . | |
| 4,795,217 | 1/1989 | Hilaris . | |
| 4,813,611 | 3/1989 | Fontana . | |
| 4,921,374 | 5/1990 | Stutzman . | |
| 4,936,031 | 6/1990 | Briggs et al. . | |
| 4,991,321 | 2/1991 | Artzberger . | |
| 5,016,717 | 5/1991 | Simons et al. | 299/17 |
| 5,120,165 | 6/1992 | Walko, Jr. . | |
| 5,140,759 | 8/1992 | Artzberger . | |

OTHER PUBLICATIONS

Thermodynamics" by Van Wylen and Sonntag, pp. 575-594.

Briggs Technology Brochures for the Models X1-X4 Air Knives, V1, V30, V35, V40 and V45 Excavators, and VX100 Mobile Excavator.

An Advertisement from MBW, Inc.

Article dated Jul. 20, 1987 Design News.

Excerpt from Pipeline and Utilities Construction, p. 26, illustrating a supersonic knife marketed by Gas Energy, Inc.

Advertisement on p. 55 of the Feb., 1989 issue of an unknown reference is an ad for Gas Energy, Inc.

An unidentified article entitled "Air Knife Makes Easier for Utility Crews".

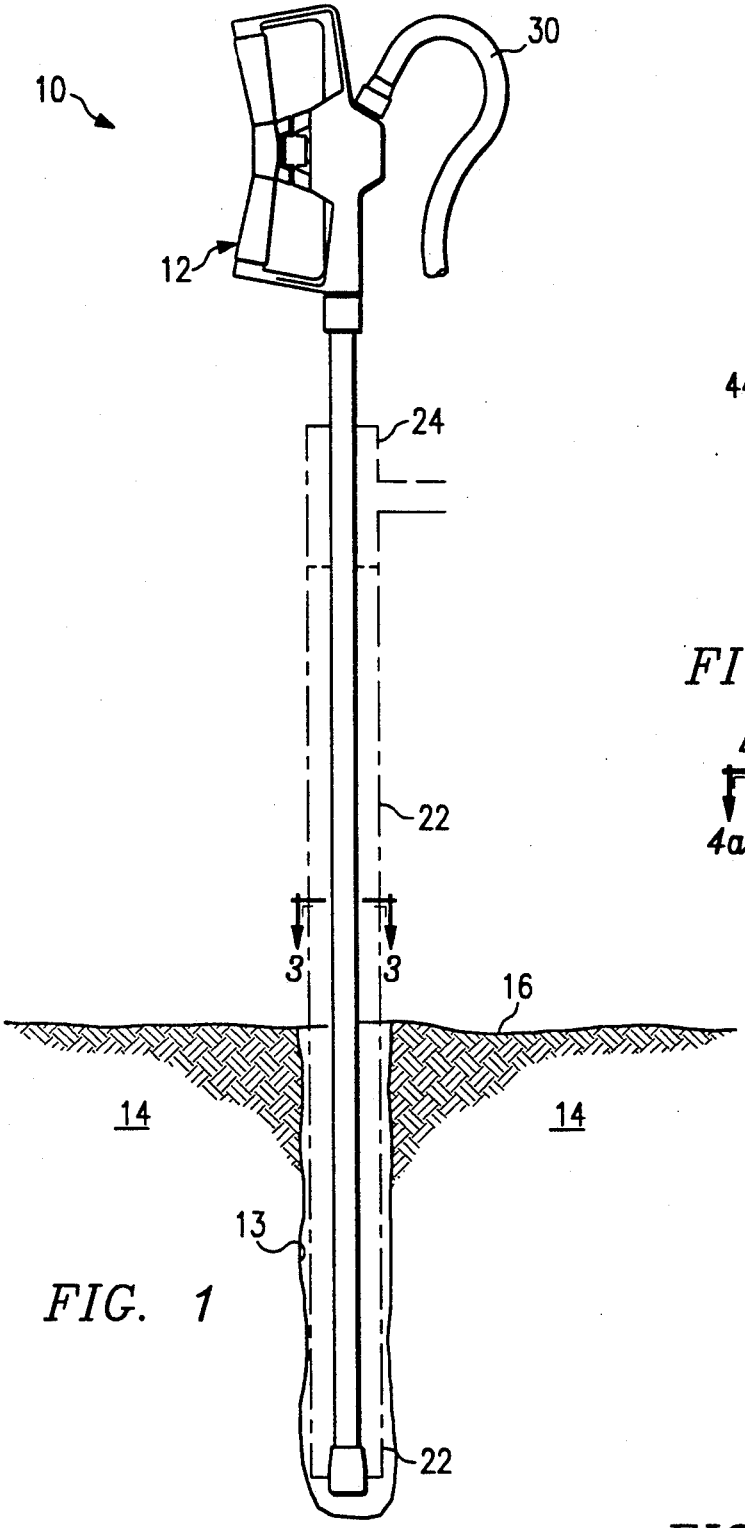
FIG. 1
FIG. 3
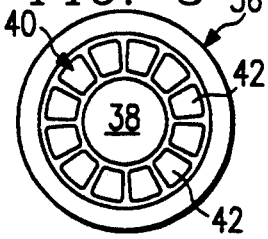
FIG. 4a
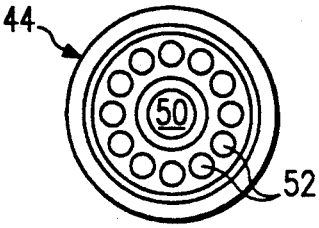
FIG. 4b
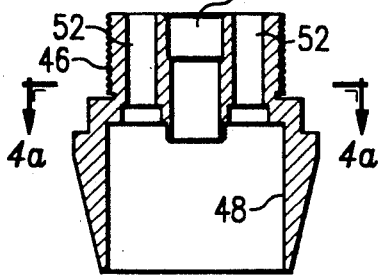
FIG. 5
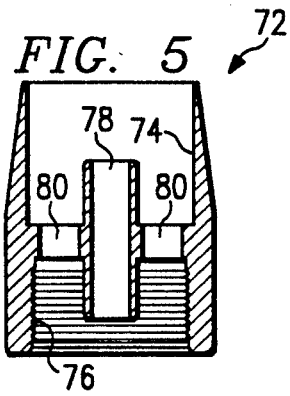
FIG. 6
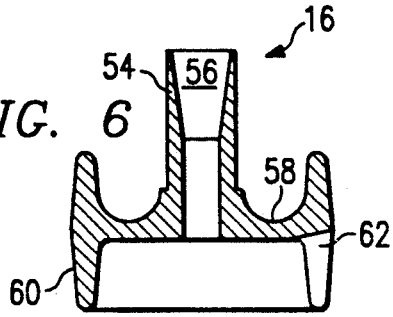

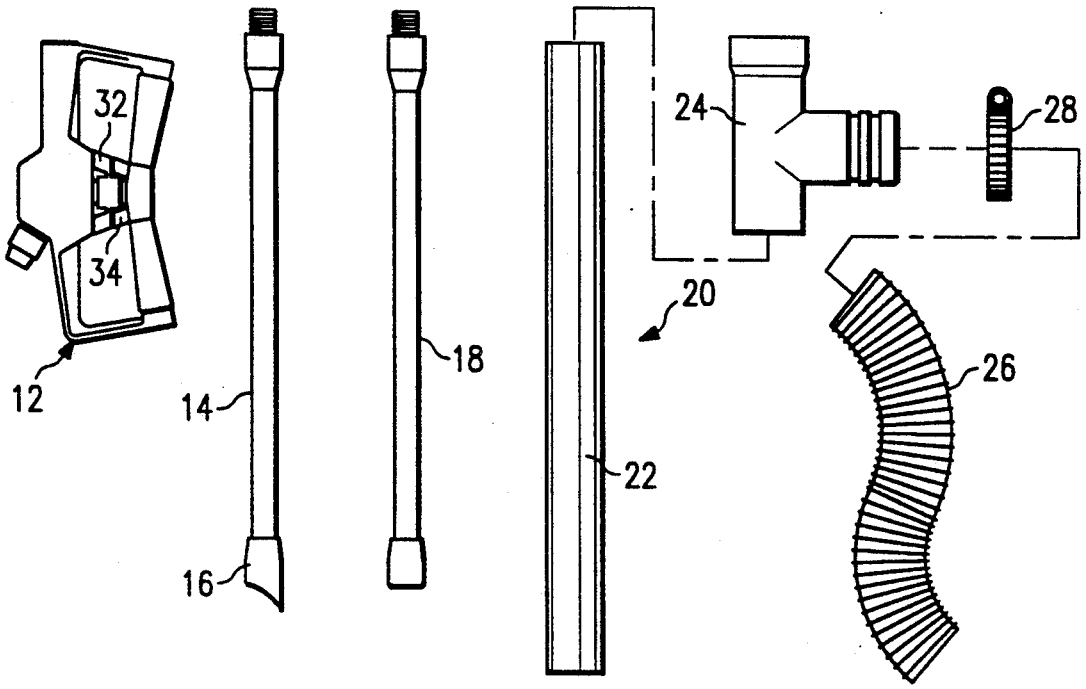
FIG. 2
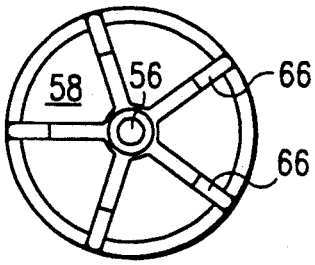
FIG. 7a
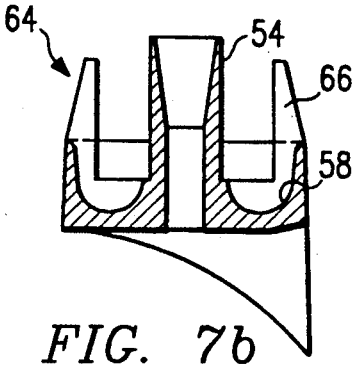
FIG. 7b
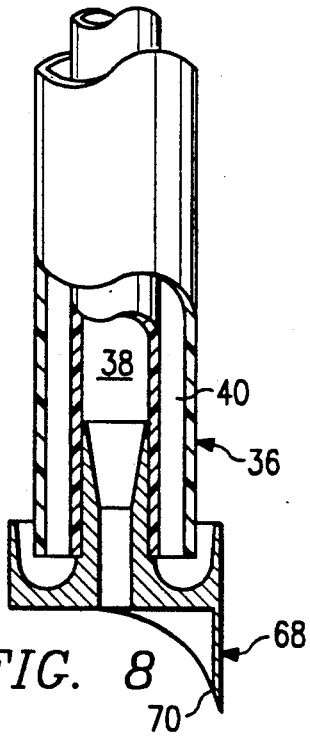
FIG. 8
FIG. 11
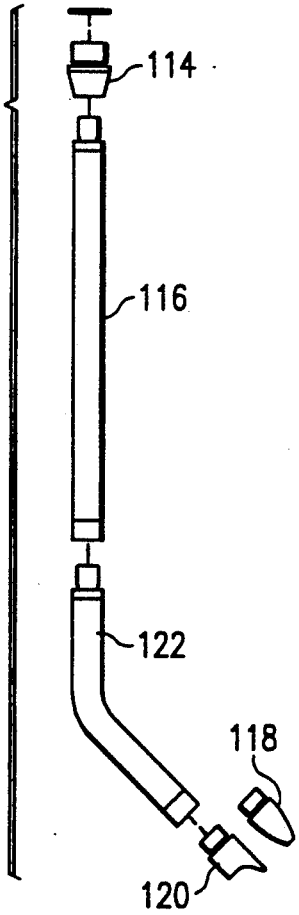

FIG. 13
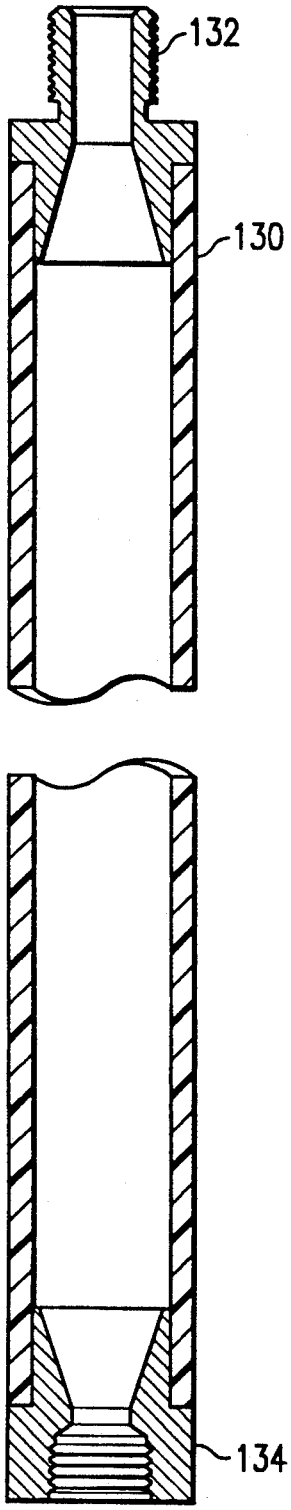
FIG. 12
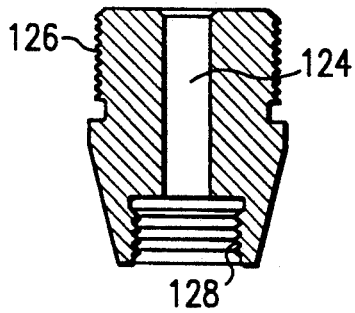
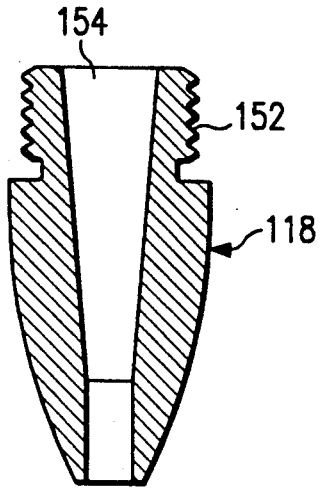
FIG. 15
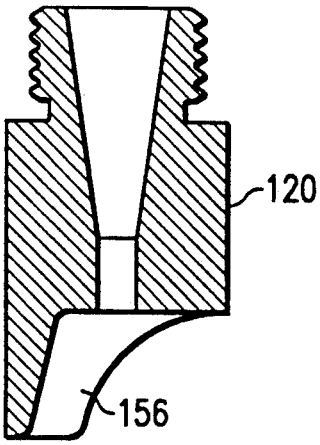
FIG. 16
FIG. 14
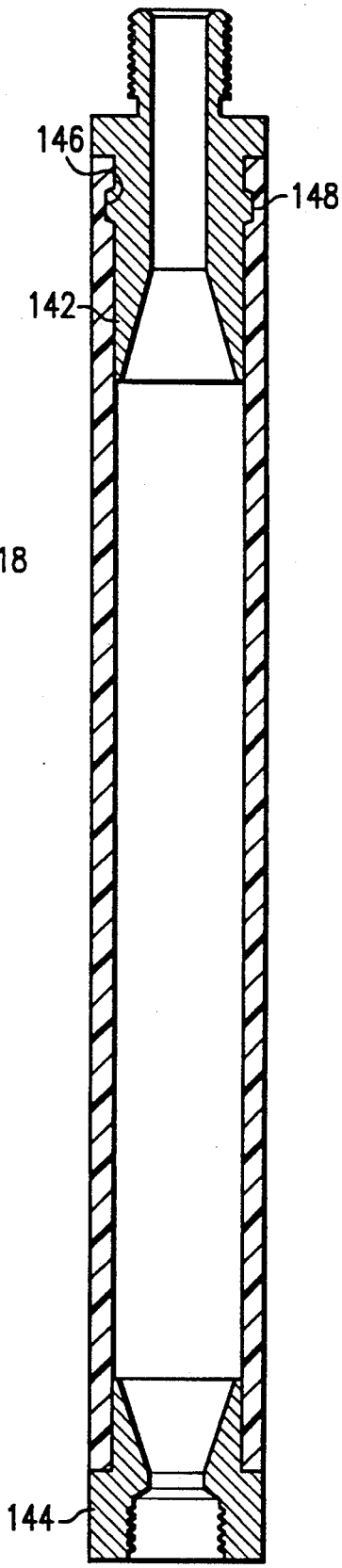

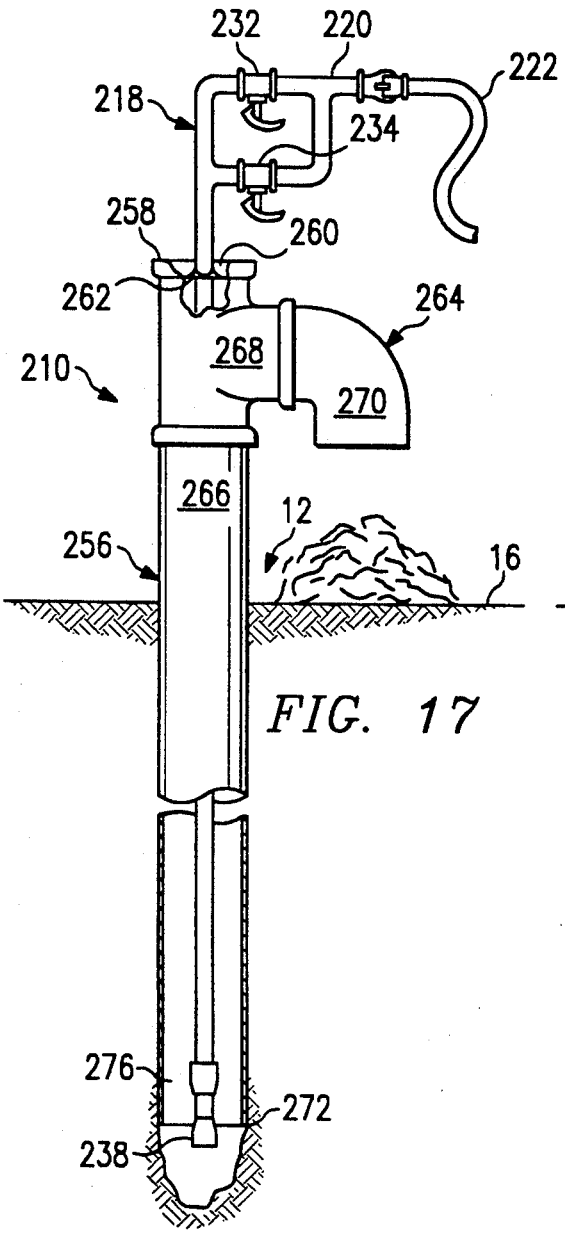
FIG. 17
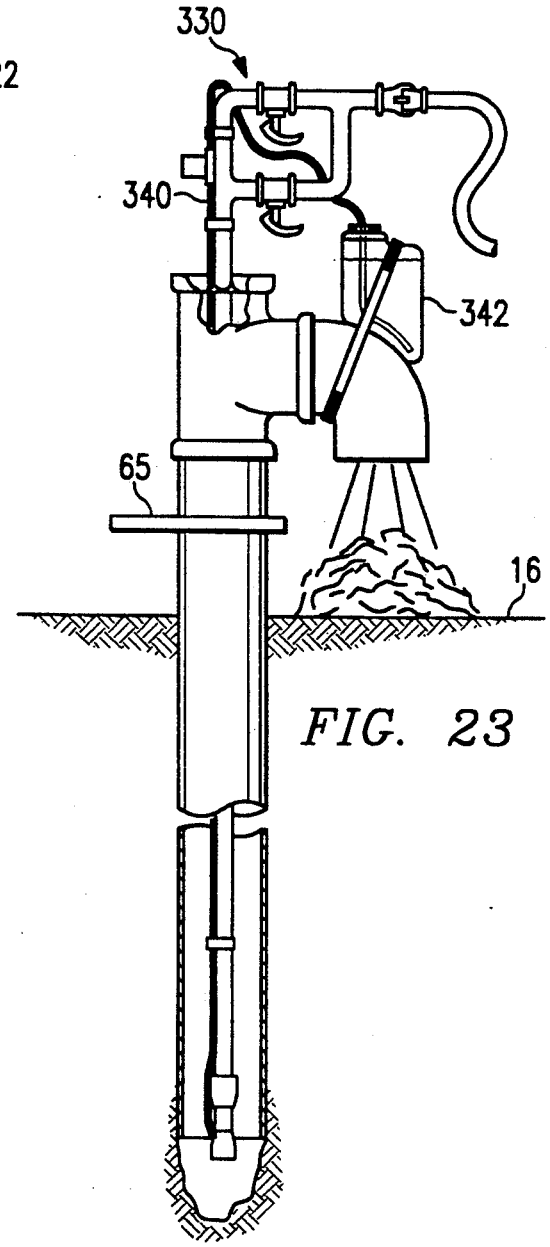
FIG. 23
FIG. 18
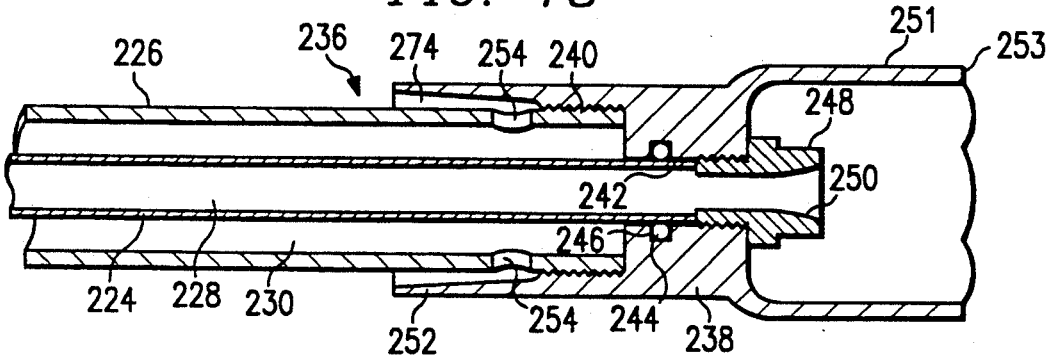

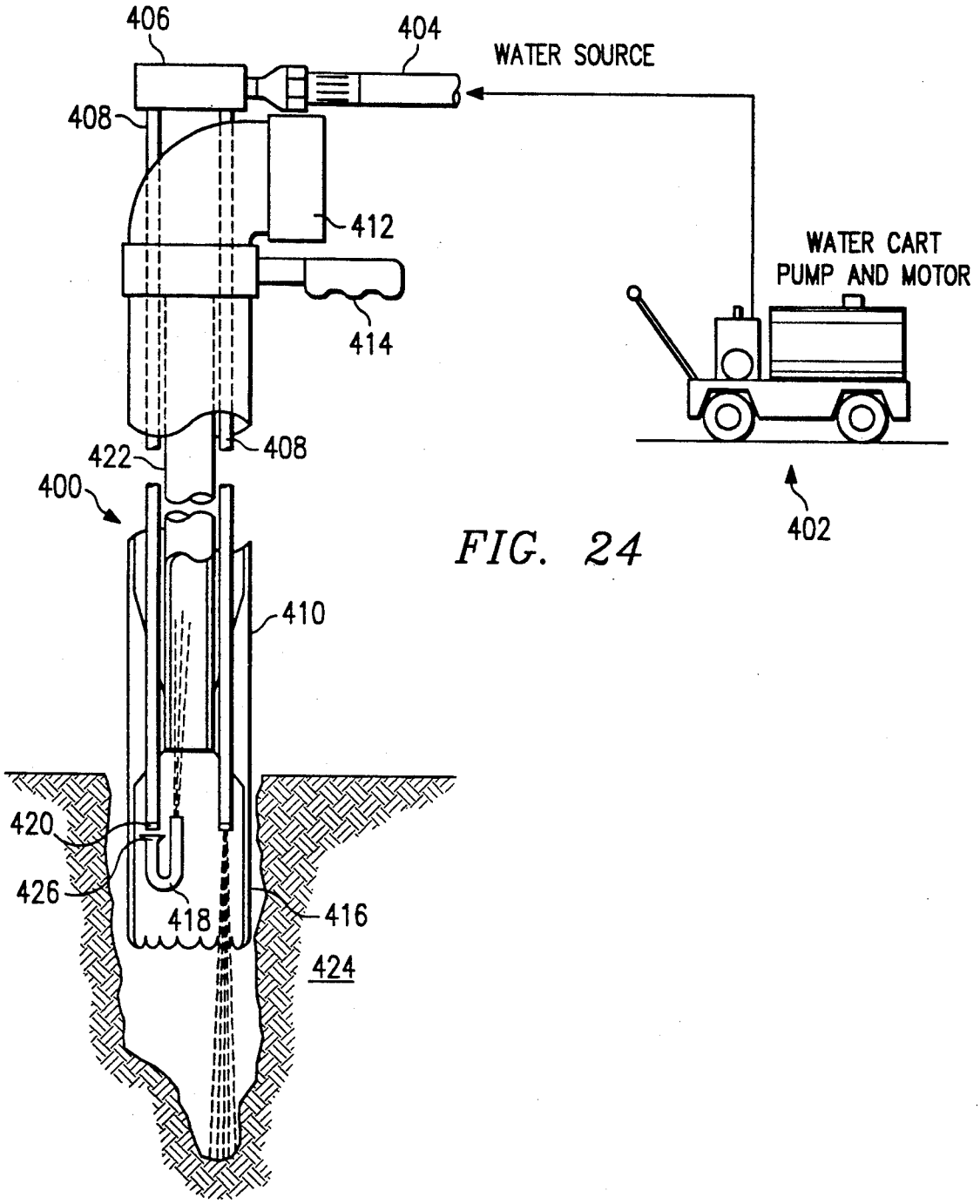
FIG. 24
FIG. 25
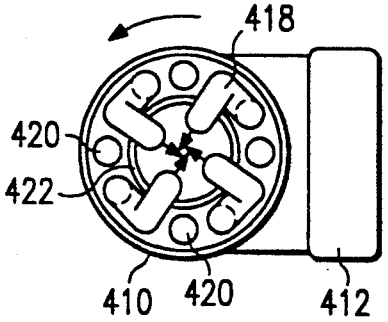

SOFT EXCAVATOR

TECHNICAL FIELD OF THE INVENTION

This invention relates to the excavation of materials, and particularly the excavation of ground to locate underground lines for repair of existing underground lines without use of mechanical digging apparatus which can damage the line.

BACKGROUND OF THE INVENTION

There is a frequent need for material excavation. For example, an excavation of ground may be required to locate and expose an existing underground line, such as a sewer, water, power or telephone line to repair those underground lines. One technique commonly used for such excavation is a mechanical ditch digger or backhoe. However, where the location of the line to be repaired is not know precisely, or where the repair is to be made only in a specific area, the use of mechanical excavating devices often necessitates the excavation of far more of the ground than is necessary. Further, the use of such mechanical excavating techniques can often damage the line. Of course, excavating by hand is always possible, but this approach is becoming ever more expensive with the cost of labor and is relatively slow.

One device which has been developed in an attempt to solve these needs is an air excavation tool disclosed in U.S. Pat. No. 4,936,031 issued Jun. 26, 1990 to Briggs, et al. The tool includes a source of high pressure air which is directed through a device at the material to be excavated, with the air expelled at supersonic velocities. The air penetrates the ground and breaks up the ground for removal by a secondary air flow system. However, a need stills exists for enhanced devices and methods utilizing this or similar basic soft excavation techniques.

SUMMARY OF THE INVENTION

In accordance with one aspect of the present invention, an apparatus is provided for excavating material by use of a fluid such as air or water at high velocity. The apparatus includes a member having a first passage formed therein. The first passage has a first end connected to the source of fluid at high pressure and a second end. A nozzle having an orifice connected to the passage is secured to the member at the second end of the passage to direct fluid at high velocity exiting from the passage against the material to be excavated.

In accordance with another aspect of the present invention, the member further includes a second passage therein, the second passage having a first opening connected to the source of fluid at high pressure and a second opening spaced a predetermined distance from the second opening of the first passage. The apparatus further includes structure mounted on the member for directing and guiding the fluid flow exiting from the second opening of the second passage in a direction generally opposite the direction of the high velocity fluid exiting from the second opening of the first passage to generate a force sufficient to move excavated materials away from the excavation site for disposal.

In accordance with another aspect of the present invention, the nozzle is removable for easy replacement. The nozzle can have an orifice that is a straight bore or a tapered bore. The apparatus can further be provided with a tapered tip or other configuration tip circumferentially positioned about the jet nozzle to provide a shearing function to mechanically trim the wall of the excavation.

In accordance with further aspects of the present invention, the apparatus can include an inner pipe and an outer pipe concentric therewith. A replaceable tip can be mounted on the outer pipe. The tip includes the jet nozzle and a skirt forming the guide structure. In another embodiment, the jet nozzle forms the end of the inner pipe and a skirt is secured to the outer pipe to form the guide structure. In accordance with another aspect of the present invention, structure is provided for supplying a material to the fluid flow exiting the second opening of the first passage to enhance the excavation.

BRIEF DESCRIPTION OF THE DRAWINGS

For a more complete understanding of the present invention, and the advantages thereof, reference is now made to the following Description taken in conjunction with the accompanying Drawings, in which:

FIG. 1 is an illustrative view of a soft excavator forming a first embodiment of the present invention;

FIG. 2 is an illustrative view of various components and accessories that can be used with the soft excavator;

FIG. 3 is a cross-sectional view of the wand tube used in the soft excavator;

FIGS. 4*a* and 4*b* are views of the head of the wand;

FIG. 5 is a cross-sectional view of the end of the wand extension;

FIG. 6 is a cross-sectional view of a wand nozzle used with the soft excavator;

FIGS. 7*a* and 7*b* are views of a modified nozzle for the wand;

FIG. 8 is a cross-sectional view of the lower portion of the wand illustrating the nozzle;

FIG. 11 is an illustrative view of accessories that can be used with the soft excavator;

FIG. 12 is a cross-sectional view of a wand adapter;

FIG. 13 is a cross-sectional view of an extension;

FIG. 14 is a cross-sectional view of an angled extension;

FIG. 15 is a cross-sectional view of a bullet nozzle;

FIG. 16 is a cross-sectional view of a shearing nozzle;

FIG. 17 is an illustrative view of a soft excavator forming a second embodiment of the present invention in operation;

FIG. 18 is a cross-sectional view of the air excavator tip of the soft excavator of FIG. 17;

FIG. 23 is an illustrative view of the soft excavator of FIG. 22 in use;

FIG. 24 is a cross-sectional view of a sixth embodiment of the present invention;

FIG. 25 is an end view of the embodiment of FIG. 24;

DETAILED DESCRIPTION

Figure 10:
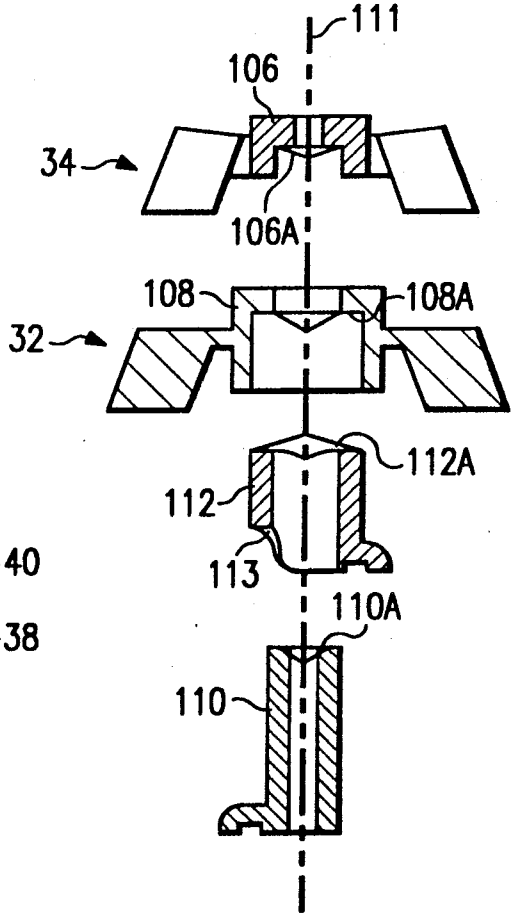
FIG. 10 is a view of the valve components used in the handle.

With reference now to the following Detailed Description, taken in conjunction with the attached Drawings, where like reference numerals indicate like or corresponding parts throughout several views, there is illustrated in FIG. 1 a soft excavator 10 forming a first embodiment of the present invention. As illustrated, the soft excavator 10 is employed to excavate a cylindrical borehole 13 into ground 14 from the ground surface 16 such as may be desired to locate an underground line for repair. However, it should be understood that the soft excavator 10, and the other embodiments disclosed herein, could be utilized to excavate a trench or ditch, or to excavate or displace many types of material, including, for example, gravel, sand, water in a depression, and the like.

With reference to FIG. 2, many of the components of and accessories for the soft excavator 10 are illustrated. The soft excavator 10 includes a handle 12, and a wand 14 with a wand nozzle 16 from which is discharged fluid at high pressure, such as air or water, to excavate the ground or surface. Nozzle 16 can be removable, or permanently mounted on the wand. A wand extension 18 can be utilized to effectively lengthen the wand if a deeper hole is to be excavated. A casing 20 can be used with the soft excavator 10 if the hole is being dug in material which is unstable so that the hole excavated would otherwise cave in, or when it is desired for other reasons to put a casing in the hole. The casing can be seen to include a straight discharge or spoil tube 22, a discharge or spoil hood 24 which is secured at one end of the tube and a flex hose 26 which is clamped to &:he hood by a clamp 28. As will be discussed in greater detail hereinafter, the material excavated by the soft excavator will be driven up the interior of the discharge tube 22 into the discharge hood 24. The excavated material or spoils are carried up and out of the casing 20 and deflected sideways by hood 24. The hood deflection prevents spoils from striking the operator and orients the spoils for disposal. A gasket is provided in the discharge hood 24 which fits about the outer circumference of the wand to prevent the excavated material from passing thereby and interfering with the handle 12 or bombarding the operator. Instead, the excavated material will flow from the hood 24 through the flex hose 26. The flex hose can be positioned with its free end in a bucket or container to provide ready removal of the material excavated or to refill the hole for excavation site restoration, or the material can be neatly deposited directly on the ground near the hole for backfilling after the operation is complete.

The handle 12 is connected to a source of a fluid at high pressure, such as air or water, through an air hose 30. The source of air at high pressure can be an air compressor powered by diesel or gasoline engine, or any other suitable air source. An air source capable of providing air pressure in the range of 90–100 psi at 175 cfm would be appropriate. Discharge air speeds of Mach 2.5 can be achieved. A suitable supply of water for excavations of this type has been found to be 5 gpm at 1200–1500 psi.

As will be described in greater detail hereinafter, the handle includes an excavate control valve 32 which allows the operator to control the supply of fluid to the wand nozzle for excavation. The handle 12 also includes an evacuate control valve 34 for operator control of the fluid flow to remove the material excavated from the site.

With reference to FIG. 3, the ward 14 can be seen to include a wand tube 36. The wand tube 36 is seen in cross-section to have a construction defining a central first inner passage 38 and a circumferentially oriented outer passage 40 formed by a series of individual conduits 42 formed along the tube. For example, the wand tube can be formed of pultruded fiberglass. The outer diameter of the tube can, for example, be 1¼ inches while the diameter of the inner passage 38 is ½ inch.

With reference to FIGS. 4*a* and 4*b*, a wand head 44 is mounted at one end of the tube 36. The head 44 has a male threaded portion 46 to screw into the handle 12 and a cylindrical receptacle 48 to receive the end of the tube 36. If the tube is of fiberglass, and the wand head of aluminum, the tube can be effectively bonded to the aluminum wand head 44 by a suitable adhesive such as Loctite ®, Super Bond ® or other Cyanoacrylate Gel. The wand head can be seen to include a continuation of the inner passage 38 which is defined as center passage 50. The wand head 44 similarly forms a continuation of the outer passage 40 with a series of holes 52 which are generally aligned with the conduits 42 in the wand tube 36. By making the tube 36 of a nonconductive material, the operator will be protected from electrocution if the device accidentially touches a live conduit underground.

With reference now to FIG. 6, the opposite end of the wand tube 36 can be seen to mount the wand nozzle 16. The nozzle 16 has a tubular portion 54 with an outer diameter sized to fit tightly within the inner passage 38 of the wand tube 36. The tubular portion has a through passage 56 which forms a continuation of the inner passage 38 for discharge of the fluid flowing through the inner passage. The fluid in the outer passage 40, in contrast, impacts upon a radiused toroidal surface 58 which essentially reverses the direction of motion of the fluid flowing through the outer passage 40 so that that fluid flows upward along the outer surface of the wand tube.

As can be readily seen, the discharge of the fluid through the inner passage 38 is utilized to excavate the material or ground. The nozzle 16 has a skirt 60 which forms a cylindrical shroud about the discharge from the inner passage. The skirt has three slots 62 formed at uniform spacing around the circumference of the skirt as seen in FIG. 6 and in addition to, or in substitute for, a tapered edge to facilitate mechanical shearing of the soil to assist the fluid digging properties. As material is excavated due to the fluid issuing from the inner passage 38, the flow through the outer passage, which is turned back upon itself by the nozzle 16, will drive the excavated material along the wand and away from the surface of excavation for disposal. In one embodiment, the wand nozzle is made of aluminum. If the nozzle is made of a material to avoid sparks when the nozzle strikes an underground line or conduit, the excavation tool will reduce the possibility of explosion or fire if the line is leaking. If the diameter of the inner passage 38 is ½ inch, the outer diameter of the tubular portion can be 0.51 inches, or slightly larger to form an interference fit. The radius of the toroidal surface 58 can be about 0.215 inches.

FIGS. 7*a* and 7*b* illustrate a modified wand nozzle 64 which is identical to nozzle 16 in many respects. However, the nozzle 64 has the addition of five fins or extensions 66 which extend generally along the length of the wand to add strength, particularly if the nozzle is made of a material other than aluminum. The fins also direct the excavated material upward along the wand for disposal.

FIG. 8 is a cross-sectional view of the soft excavator using a second modified wand nozzle 68 which is provided with a single scalloped edge 70 which effectively shears the walls of the hole being excavated.

With reference to FIG. 5, a wand extension 18 can be formed with wand tube 36, wand head 44 and a wand end 72 at the opposite end of the tube. The wand end 72 is, in a sense, a mirror image of the wand head 44. The wand end includes a cylindrical receptacle 74 to receive the end of the wand tube. A female threaded portion 76 is provided with threads to receive the male threaded portion 46 of the wand 14. A center passage 78, through the end 72, forms a continuation of the inner passages 38 in the wand tubes. A series of circular holes 80 are aligned with the conduits 42 in the wand tubes as well. The end 72 can, for example, be made of nylon.

Figure 9:
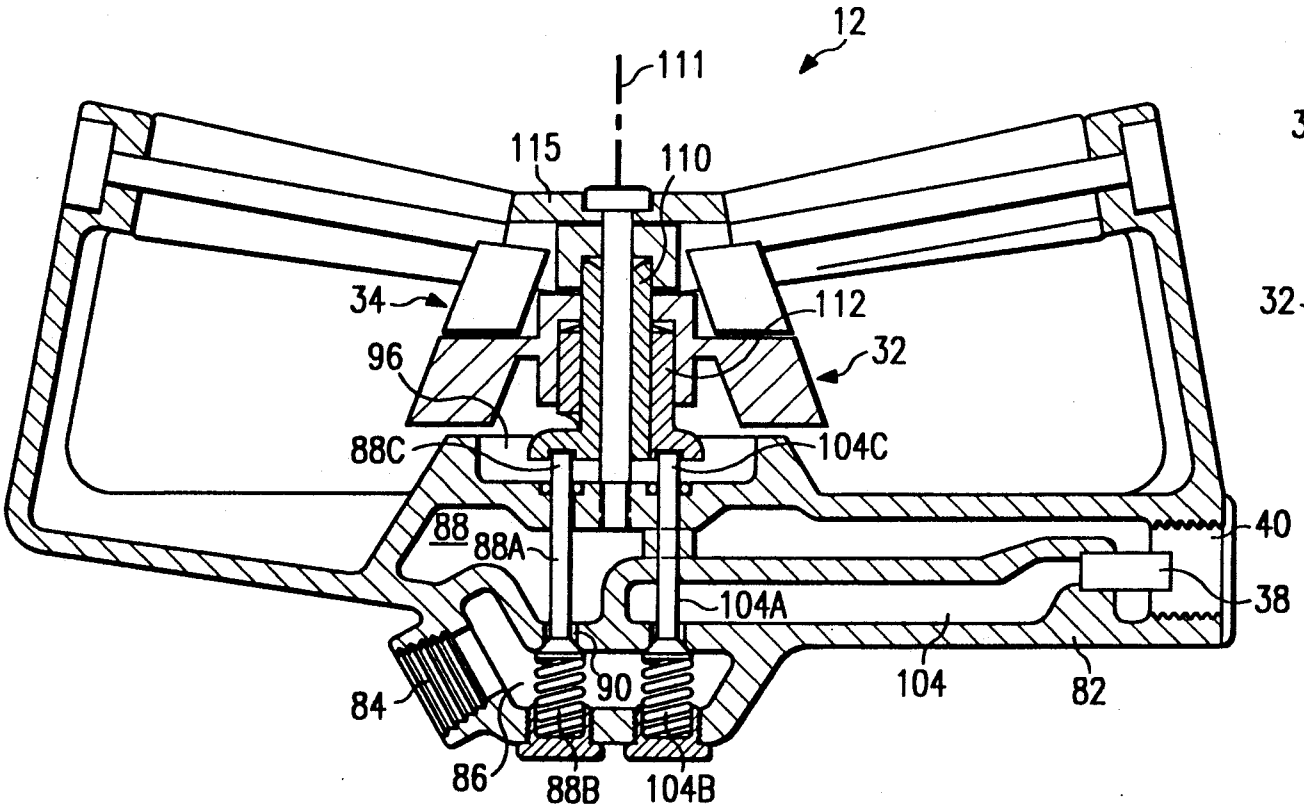
FIG. 9 is a cross-sectional view of the handle used in the soft excavator.

FIGS. 9 and 10 illustrate details of the handle 12. The handle 12 includes a cast metal main body 82 with fluid passages formed therein which connect the single supply source of fluid at high pressure from hose 30 to the inlet 84 in the handle. The fluid is supplied at all times to cavity 86 within the body 82, and selectively past valve 88A through a connecting passage 90 to cavity 88 to supply fluid (air pressure or water) to evacuate, and selectively past valve 104A to passage 104 to supply fluid (air or water) for excavation. Valves 88A and 104A are biased closed by helical springs 88B and 104B, respectively. An end 88C and 104C of each valve extends up to cavity 96. With specific reference to FIG. 10, valve handles 106 and 108 and associated valve elements 110 and 112 can be used to push down valves 88A and 104A to selectively provide fluid through the inner and outer passages. An advantage of the handle 12 is that both left and right handed operators can use the excavator with equal facility. The handles and elements are nested relative to each other and the handles are confined to prevent movement along the centerline 111 of the handle by extension 115 of the handle, but are permitted to pivot about the centerline 111. Elements 110 and 112 are permitted to move along centerline 111 a distance to control the valves 88A and 104A, but cannot pivot about the centerline because an arm of element 110 receives the upper end of valve 88A while an arm of element 112 receives the end of valve 104A. The handle 106 and element 110 have mating cam surfaces 105A and 110A which cause element 110 to move downward along centerline 111 to open valve 88A whenever handle 106 is pivoted either way from rest about centerline 111. Handle 108 and element 112 have similar mating cam surfaces 108A and 112A to operate in a similar manner. Note the cutout 113 in element 112 which allows element 110 to move along the centerline independent of element 112.

With reference now to FIGS. 11–16, various accessories for use with the soft excavator 10 are illustrated. With specific reference to FIG. 11, the accessories can be seen to include an adapter 114 which is threadedly received into the end 72 of the wand extension, or even into the handle 12 if desired. The adapter 114 can be used when only excavation is desired. The adapter 114 effectively plugs the evacuation path but permits the excavation flow to go to the nozzle. An extension 116 is, in turn, threaded into the adapter 114. A bullet nozzle 118 or a shearing nozzle 120 can be threaded into the opposite end of the extension 116 if desired. Alternatively, an angled extension 122 can be threaded into the free end of extension 116 and either of the nozzles 118 or 120 threaded to the angle extension.

With reference to FIG. 12, details of the adapter 114 are illustrated. The adapter can be formed of aluminum with a through passage 124 of diameter generally equal to the inner passage diameter 38. The male threaded portion 126 can be threadedly received in the wand end 72 or in the handle 12 and, for example, can comprise a $1\frac{1}{4}$ inch diameter thread with seven threads per inch. The female threaded portion 128 can comprise a threaded portion, for example, $\frac{7}{8}$ inch diameter with fourteen threads per inch.

FIG. 13 illustrates the construction of the extension 116. The extension can include a straight tube 130 with a male connector 132 at one end and a female connector 134 at the opposite end. The connectors 132 and 134 can, for example, be made of aluminum, nylon or delrin. The connectors can be glued to the ends of the tube by a cyanoacrylate gel or equivalent adhesive. Preferably, the connectors each have a passage formed therethrough of a diameter no smaller than that of the inner passage 38. Thus, the inner diameter of the tube 130 would generally be larger than the diameter of inner passage 38 and the connectors may have tapered portions 136 to smooth fluid flow therethrough. The threads of connectors 132 and 134 would generally be the same as the thread of portion 126.

With reference to FIG. 14, the details of the angle extension 122 can be illustrated. The angle extension is formed of an angled tube 140 which has a male swivel connector 142 at one end and a female connector 144 at the opposite end. The female connector 144 is essentially identical to female connector 134. However, the male connector 142, while including the basic structure of male connector 132, is also provided with an annular rim 146 which is received in a groove 148 in the inner surface of the tube 140 which allows the male connector 142 to swivel relative to the angled tube 140 about their centerline 150 while retaining an essentially fluid-tight connection. This permits the operator to pivot or swivel the end of the angled tube 140 relative to the handle 12 to get at a particular excavation point.

FIGS. 15 and 16 illustrate details of the nozzles which can be used with the extensions 116 and 122. With reference to FIG. 15, the bullet nozzle 118 can be seen to have a male threaded portion 152 to be received in connector 144 or 134, as desired. The aperture 154 through the nozzle preferably tapers toward its opening but can be straight. For example, if the central passage is $\frac{1}{2}$ inch, the minimum diameter of aperture 154 may be about $\frac{1}{4}$ inch expanding again then to about 5/16 inch. This technique accelerates the air to supersonic speeds. Reference to FIG. 16 will illustrate the shearing nozzle 120 has a scalloped or shearing surface portion 156 which extends from one side of the nozzle which facilitates excavation from the sidewall of the hole being excavated. It also has an aperture which tapers toward its opening and is flared slightly, or can be straight.

In operation, the soft excavator is positioned where the borehole 12 is to be dug. The wand 14 can be inserted into the casing 20 if the casing is to be used so that the lower end of the casing and the wand nozzle are approximately adjacent to one another. The valves 32 and 34 can then be opened to supply fluid (air or water) at high pressure to the passages 38 and 40. The fluid exiting the passage 38 will penetrate the ground and loosen the ground in the site exposed to the fluid flow. The fluid flow through the outer passage 40 will, in turn, be reversed on itself by the nozzle and drive the excavated ground upward along the wand to remove the material from the excavation site.

When using either extension 116 or 122, the fluid flow is only through the inner passage 38 and the advantages of the flow to evacuate the material are not used.

With reference to FIGS. 17 and 18 as well, an excavator 210 forming a second embodiment of the present invention can be seen to include a tubular wand 218 which is connected at a first end 220 to a source of high pressure air or water (not shown) through a hose 222. The source of high pressure air can be an air compressor powered by a diesel or gasoline engine, or any other suitable air source. An air source capable of providing air pressure in the range of 90–100 psi at 175 cfm would be appropriate. A suitable supply of water for excavation of this type has been found to be 5 gallons per minute (gpm) at 1200 to 1500 psi.

The wand 218 includes an inner tube 224 and a concentric outer tube 226, as best seen in FIG. 18. A passage 228 is formed through the interior of the inner tube 224 while an annular passage 230 is formed between the tubes 224 and 226. The high pressure air is supplied to the passage 228 through an excavate control valve 232 on the wand. Similarly, high pressure air is supplied to the annular passage 230 through an evacuate control valve 234.

With reference now to FIG. 18, the second end 236 of the wand 218 can be seen to mount a one-piece replaceable tip 238 which is threaded onto the threaded end 240 of the outer tube 226. The tip 238 has a through bore 242 along its center axis. The inner tube 224 is received in a portion of the bore 242. An O-ring 244 is received in an O-ring groove 246 forming part of the bore 242 to seal against the outer surface of the inner tube 224. The seal formed by the 0-ring isolates the passage 230 from passage 228. A jet nozzle 248 having a diverging bore 250 is threadedly received in the bore 242 and connects with the passage 228 through the inner tube 224. A cylindrical extension 251 having a shearing edge 253 is also part of tip 238. Extension 251 could alternatively have a single shearing scallop as, for example, nozzle 120.

The tip 238 is also provided with an evacuator skirt 252 which extends along a portion of the outer surface of the outer tube 226. One or more evacuator orifices 254 pass through the wall of the outer tube near the threaded end 240. The evacuator skirt acts to direct the air flow from the annular passage back along the outer surface of the outer tube 226 in a direction generally opposite the air discharge from the jet nozzle 248.

With reference again to FIG. 17, the wand 218 can be seen to be inserted into a casing 256. The wand is inserted through the top 258 of the casing through an opening 260 having a protective flap 262. The flap 262 bears against the outer surface of the tube 226 to resist passage of air or evacuated material through the opening 260. An elbow bend 264 forms part of casing 256 near the top 258 which directs the evacuated material from the casing for collection or disposal.

In one construction, the casing 256 was constructed of PVC plastic or fiberglass with a diameter of 2½ to 3½ inches. The casing was constructed of three pieces, a straight section 266, a tee 268, and an elbow 270.

In operation, the soft evacuator is: positioned where the borehole 12 is to be dug. The wand 218 is inserted through the opening 260 into the casing 256 so that the lower end 272 of the casing and the tip 238 are approximately adjacent one another. The valves 232 and 234 are then opened to supply high pressure air to the passages 228 and 230. The air flowing through the passage 228 is directed by the jet nozzle 248 against the ground surface 16. Preferably, the air flow is supersonic as it leaves the jet nozzle 248 to enhance the excavation characteristics of the device. The supersonic air flow will penetrate and loosen the ground in the site exposed to the air flow. The high pressure air flow through the annular passage 230 will, in turn, pass through the evacuator orifices 254 and along the annular section 274 between the outer surface of tube 26 and the inner surface of the evacuator skirt 252 in the direction illustrated. This flow, in combination with the flow through nozzle 248, will create a condition surrounding the excavator jet flow causing the excavated material to be driven into the casing 256 around the wand and upward toward the top 258 of the casing. The excavated material is entrained in the high velocity air flow emanating from the evacuator skirt, (once the air emanates from the skirt it becomes a low pressure, high volume flow) which assists the travel of the material up the casing and out the elbow 264 for recovery or disposal.

It can be understood that the combination of the excavator fluid flow and the evacuator fluid flow will excavate a borehole of diameter roughly equal to that of the casing 256. This can be assured by moving the soft excavating device 210 up and down as a unit or moving the wand portion around inside casing 256 as the excavation and evacuation operations are in process. As the material is evacuated, the casing and wand can be moved downward in the borehole until the final desired depth 280 of the borehole is achieved. The hole excavated can be horizontal as well, as boring a hole under a sidewalk or narrow roadway. A step 65 (see FIG. 23) can be used on the casing to help push the casing into the hole. Clearly, the straight section 266 of the casing 256 and the wand 218 can be made of length sufficient to form any reasonable borehole depth. When the borehole is completed, the wand and casing can be removed, leaving the open borehole. Alternatively, the straight section 266 of the casing can be left in the borehole to form a liner, with the wand simply being withdrawn and tee removed from the top of the casing for reuse.

Figure 19:
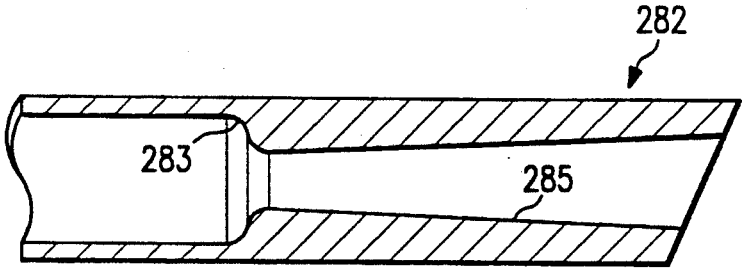
FIG. 19 (PRIOR ART)
FIG. 19 is a cross-sectional view of a prior art device.

FIG. 19 illustrates a nozzle 282 used in a prior art air knife for excavating ground. Nozzle 282 can be seen to have a converging section 283 followed by a diverging section 285 which can be used to accelerate the air flow discharging from the nozzle to supersonic speeds.

Figure 20:
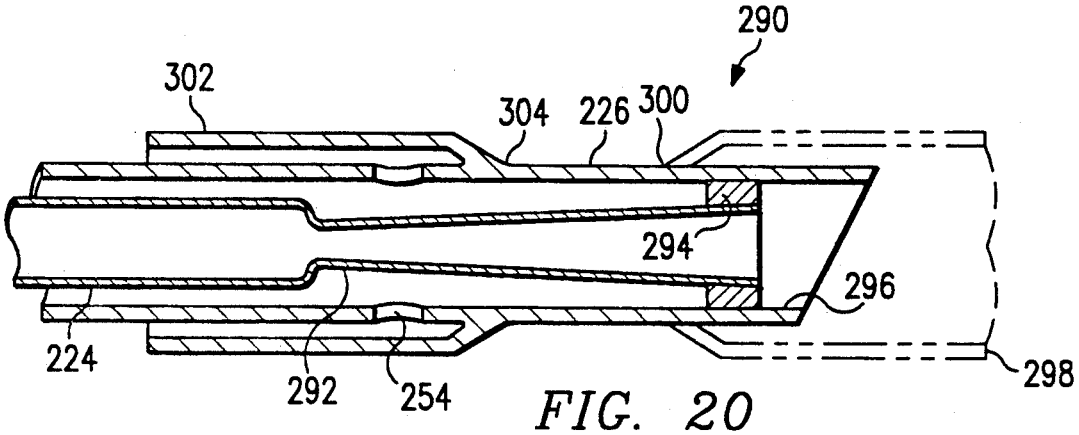
FIG. 20 is a cross-sectional view of a third embodiment of the present invention.

FIG. 20 is a partial view of a soft excavator 290 forming a third embodiment of the present invention. In excavator 290, the inner tube 224 ends in a convergent divergent jet nozzle 292. The nozzle 292 is centered within and secured to the outer tube 226 by an annular plug 294 which is welded between the tubes by weld 296. A cylindrical scalloped tip 298 is welded to the outer surface of the tube 226 by weld 300 and surrounds the opening of the jet nozzle 292. A cylindrical evacuator skirt 302 is similarly welded to the outer tube 226 over the evacuator orifices 254. The remainder of the soft excavator 290 is essential identical to that of soft excavator 210, and the device works in the same manner. In one construction of this embodiment, the annular radius between the outer surface of outer tube 226 and the inner surface of skirt 302 is 0.06 inches and four (4) orifices 254 are used, each of 0.250 inch diameter.

Figure 21:
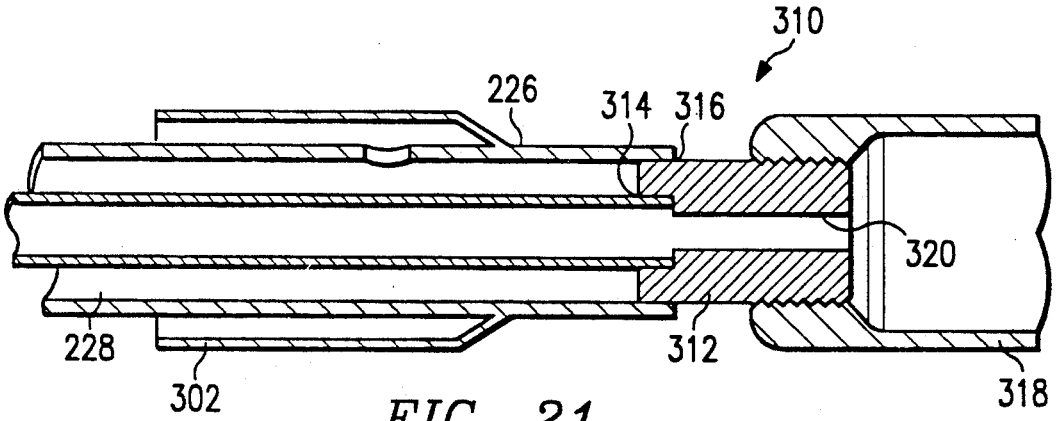
FIG. 21 is a cross-sectional view of a fourth embodiment of the present invention.

With reference to FIG. 21, a fourth embodiment of the present invention is illustrated and forms soft excavator 310. In excavator 310, a straight jet nozzle 312 is welded to the inner tube by weld 314 and to the outer tube 226 by weld 316. A changeable shearing tip 318 is threaded onto the nozzle 312 as shown. The jet nozzle 312 has a straight bore 320 passing therethrough and connected with the passage 228. A cylindrical evacuator skirt 302 is welded to the outer surface of the outer tube 226 by weld 304. In one construction of this embodiment, the annular radius between the outer surface of outer tube 226 and the inner surface skirt 302 was 0.12 inches and four (4) orifices 54 are used each of 0.250 inch diameter. Bore 320 also was 0.250 inches in diameter.

Figure 22:
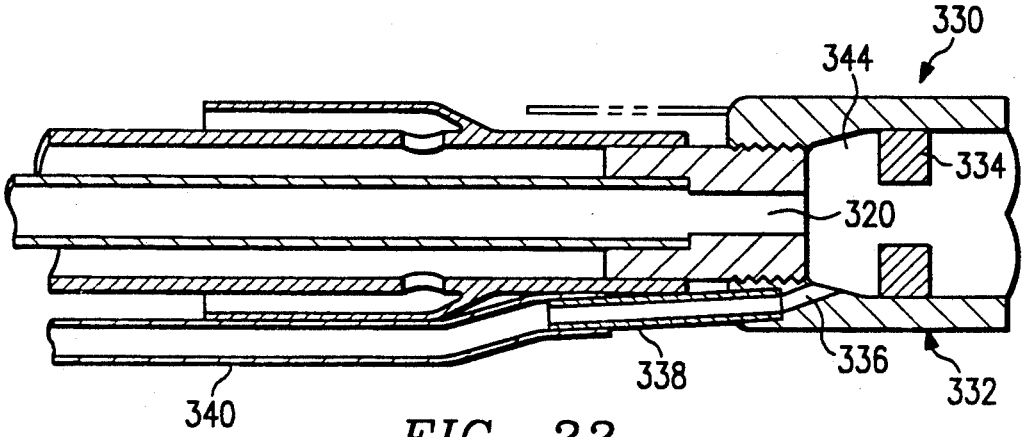
FIG. 22 cross-sectional view of a fifth embodiment of the present invention.

With reference to FIGS. 22 and 23, a soft excavator 330 forming a fifth embodiment of the present invention is illustrated. The soft excavator 330 is most similar in design to the soft excavator 310, and identical components are identified by the same reference numerals. However, the soft excavator 330 includes a changeable shearing tip 332 which includes a venturi nozzle 334 and an injector nozzle 336. Injector nozzle 336 is connected through a tube 338, pipe 340 and metering valve 341 to a supply 342 of an injection material, such as water or a granular material. As the excavator operates, the high pressure air discharge from the straight bore 320 will create a flow in the area 344 of the interior of the tip 332 surrounding the air flow to drive the excavated material from the site. This flow will draw injection material from the supply 342 for entrainment into the air flow as the air flow passes through the venturi nozzle 334 to impact the material to be excavated. By entraining water, or a granular material, the excavation capability of the excavator can be enhanced. If desired, the changeable tip, evacuator skirt and injector nozzle can be combined into one changeable tip assembly similar to tip 238.

FIGS. 24 and 25 disclose a sixth embodiment of the present invention formed by a soft excavator 400. Pressurized water is provided from a water cart pump and motor combination 402 through a hose 404 to a manifold 406. A number of water lines 408, in this design four, descend from the manifold 406 and into the outer tube 410. The outer tube 410 has a deflector elbow 412 mounted on the top thereof and a handle 414 which allows the outer tube 410 to be rotated slightly relative to the water lines 408. Near the lower end 416 of the outer tube are secured four vacuum water redirection tubes 418 which are essentially U-shaped tubes which can be oriented at the ends 420 of each of the water lines 408 to direct the water flow in the reverse direction up the inner tube 422. With reference to FIG. 25, the soft excavator 400 can be seen to be designed so that the outer tribe can be rotated to a first position, as seen in FIG. 25, relative to the water lines 408 so that the tubes 418 do, not lie over the ends 420 of the water lines 408. Thus, the material 424 is excavated by the high speed water flow from the lines as shown on the right side of FIG. 24. After some excavation is completed, the tube 410 can be pivoted with handle 414 relative to the water lines 408 to position the water lines 408 at the opening 426 of the tubes 418 which causes the flow to flow upward through the inner tube 422, generating a relative vacuum to suck the material excavated up the inner tube for disposal from the deflector elbow 412.

Figure 26:
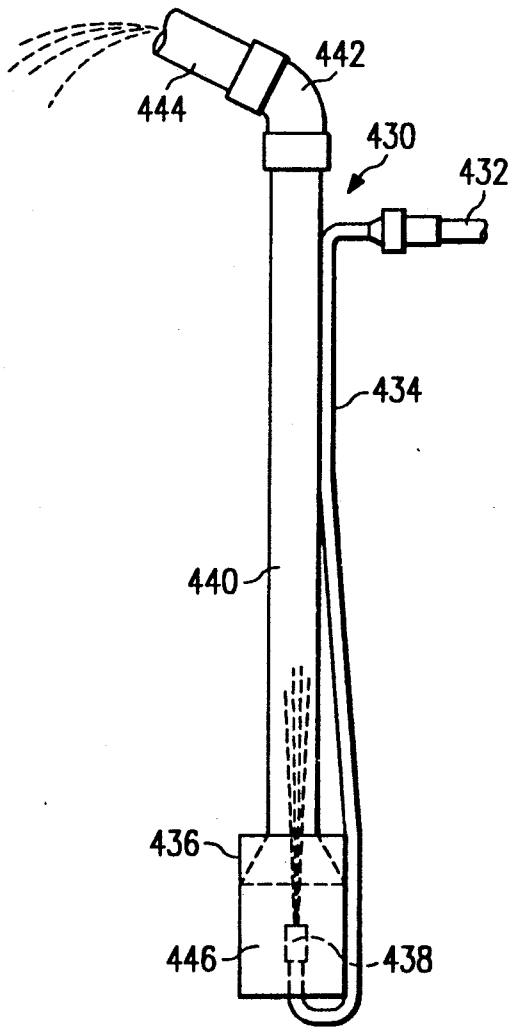
FIG. 26 is a cross-sectional view of a seventh embodiment of the present invention.

FIG. 26 illustrates a soft evacuator 430 which is used to recover excavated material for disposal. The soft evacuator includes a supply hose 432 to a source of high pressure fluid, such as water, a hydraulic line 434 which extends from the hose end to the outside of a cylindrical member 436, extends around the bottom edge of the member and up the center line of the member to end in a jet 438. Attached to the cylindrical member 436 is a tube 440 which extends upward to an elbow 442 and another tube 444.

The flow of high pressure fluid, such as water, through the hydraulic line 434 will cause a discharge at jet 438 which is directed upward through the interior of the tube 440. This flow creates a relative vacuum in the region 446 which lifts the excavated material upwardly sufficient to be entrained and driven by the flow issuing from the jet 438. The excavated material will flow along the tube 440, elbow 442 and tube 444 for disposal at a desired location. In one evacuator constructed in accordance with the teachings of the present invention, water was supplied at 3 gpm at 1400 psi pressure. The line 434 was ¼ inch steel and ended in a jet having a passage or orifice diameter of 0.062 inches. The cylindrical member 436 had an outer diameter of 2½ inches. The tube 440 had a 1 inch inner diameter and was 5 feet long.

Figure 27:
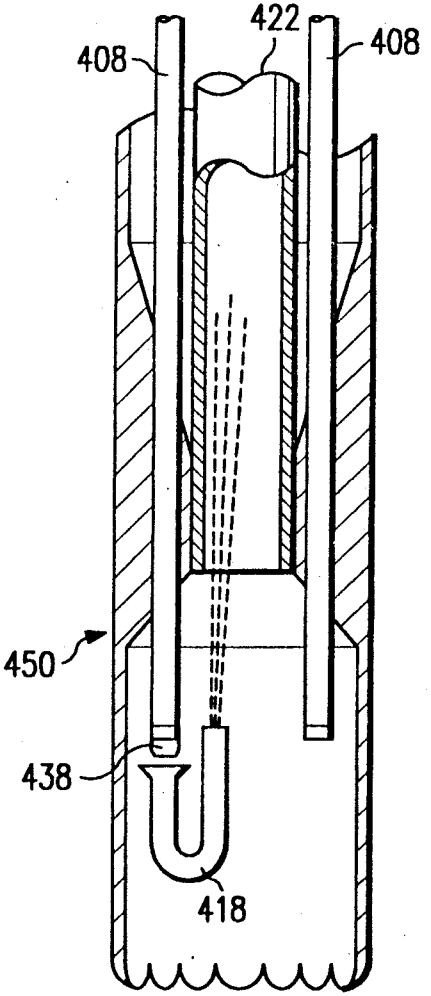
FIG. 27 is a modification of the embodiment of FIG. 24.

FIG. 27 illustrates a soft excavator 450 which has many elements in common with excavator 400 and are identified by the same reference numeral. However, soft excavator 450 does not require rotation of the outer tube 410 to select between excavating and evacuation operation. The soft excavator 450 utilizes, for example, only two vacuum water redirection tubes 418, which are oriented before the ends 420 of two of the water lines 408. The other two water lines are employed continuously for excavation. In accordance with one soft excavator design in accordance with the teachings of the present invention, water is provided through each of the water lines at 3 gpm at 1400 psi. The water lines are formed of steel. The end 420 of each of the water lines forms a jet having an orifice diameter of 0.062 inches. The inner tube 422 has a 1.125 inch inner diameter and is 5 feet long. The outer tube 410 can have a 2⅜ inch outer diameter.

Figure 28:
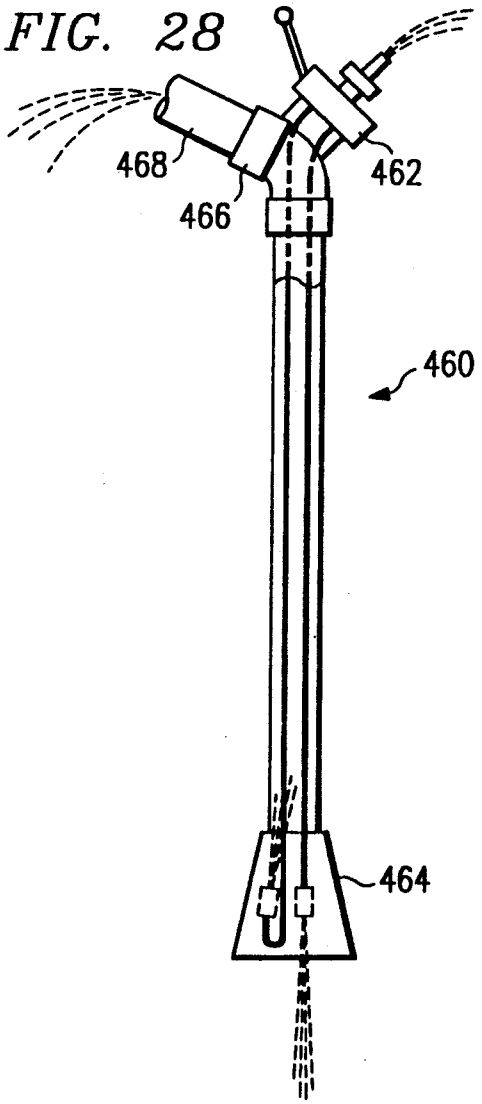
FIG. 28 is a modification of the embodiment of FIG. 24.

FIG. 28 illustrates a soft excavator 460 forming yet another embodiment of the present invention. Many of the elements of soft excavator 460 are the same as used in soft excavator 450 and are identified by the same reference numerals. Soft excavator 460 incorporates a ball valve 462 in the manifold 406 to control the water or air flow. A flared skirt 464 is secured at the lower end of the outer tube 410. The excavated material is driven upward through the tube 422 to an elbow 466, tube 468 and then to the point of collection. The ends 420 of each of the water lines can comprise nozzles having orifices. The orifices, for example, can have a diameter of between 0.030 inches and 0.060 inches.

Figure 29:
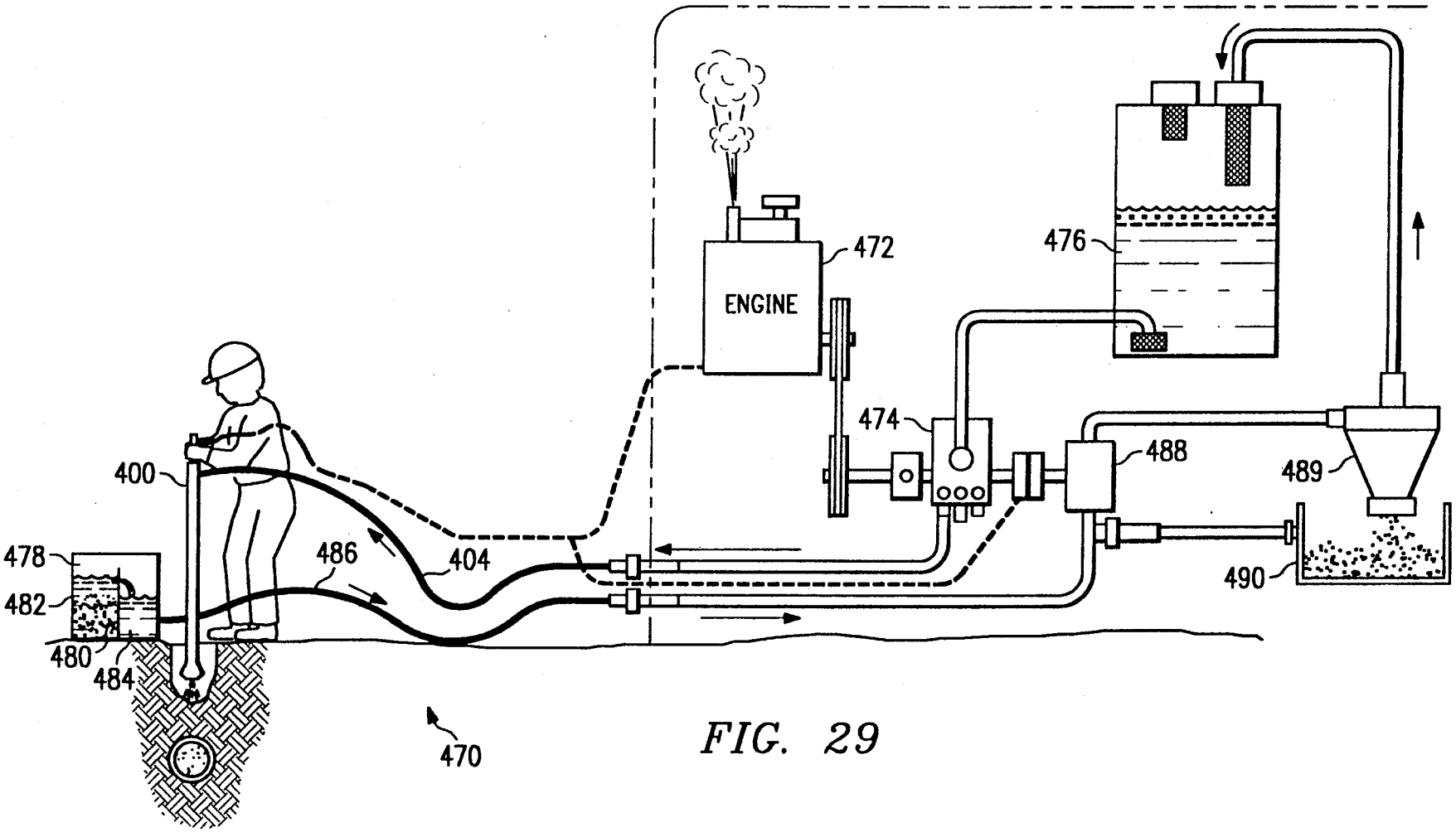
FIG. 29 is an illustrative view of the system used to operate the embodiment of FIG. 24.

FIG. 29 illustrates a system 470 for operating the soft excavator 400, 430, 450 or 460. An engine 472 drives a 5–10 gpm triple plunger pump to draw water from a fresh or filtered water source 476 and pressurizes the water to 1200–1500 psi at 5–10 gpm for delivery through hose 404. The spoils or excavated material is driven into a container 478 which has a weir 480. The spoil flow is directed into portion 482 of the container on one side of the weir where the spoils will collect at the bottom of the container. As sufficient water is discharged into the container to reach the top edge of the weir, the water begins to flow over into the second portion 484 where it can be recovered through a return line 486 which leads to the inlet of a centrifugal pump 488 also driven by the engine 472. The pump 488 can be a 5 gpm, 35 psi pump, for example. The outlet of the centrifugal pump 488 is provided to a cyclone filter 489, such as a 5 micron filter manufactured by Encylclon, Inc. to further separate the spoils from the water flow. The spoils will fall into a collection tank 490 while the filtered water is returned to the source 476 for reuse.

While several embodiments of the present invention have been illustrated in the accompanying drawings, and described in the foregoing detailed description, it will be understood that the invention is not limited to the embodiments disclosed, but is capable of numerous rearrangements, modifications and substitutions of parts and elements without departing from the spirit and scope of the invention.

We claim:

1. An apparatus for excavating material by use of high velocity fluid from a high pressure fluid source, comprising:

a member having a first passage formed therein, the first passage having a first end connected to the high pressure fluid source, and a second end;

a nozzle secured to the member at the second end of the first passage to direct fluid exiting at high velocity from the first passage against the material to be excavated;

means operative at the excavation site to drive the excavated material away from the excavation site, said driving means connected to the high pressure fluid source, said driving means further being independent of the flow through the first passage so that two separate sources of high velocity fluid are delivered to the excavation site, said driving means and said first passage being concentric; and said nozzle having a bore formed therethrough connected to the first passage, said bore being tapered inwardly and then outwardly diverging to accelerate the high pressure fluid to supersonic speeds, in the direction of flow of the high velocity fluid.

2. The apparatus of claim 1 wherein said drive means further comprises:

a second passage formed therein, the second passage having a first end connected to the high pressure fluid source and a second end spaced a predetermined distance from the second end of the first passage; and guide means mounted on the member for directing the fluid exiting at high velocity from the second end of the second passage in a direction to drive the excavated materials away from the excavation site for disposal.

3. The apparatus of claim 1 wherein said nozzle is threadedly received on said member for ready removal and replacement.

4. The apparatus of claim 1 further comprising a shearing tip mounted on said member surrounding the opening in the nozzle.

5. The apparatus of claim 1 further comprising a casing positioned about said member and nozzle, the apparatus for excavating a borehole of predetermined diameter, the casing and member moving into the borehole as it is excavated with the casing forming a lining for the borehole.

6. The apparatus of claim 5 wherein said casing has a foothold mounted thereon to facilitate pushing the member into the material being excavated.

7. An apparatus for excavating material by use of a high velocity fluid from a high pressure fluid source, comprising:

an inner tube having a first end and a second end and a center passage therethrough;

an outer tube having a first end and a second end, said outer tube concentric with said inner tube to define an annular passage therebetween;

an excavate control valve mounted between the first end of said inner tube and the source of high pressure fluid to control fluid flow to the center passage;

an evacuate control valve mounted between the first end of the outer tube and the source of high pressure fluid to control fluid flow to the annular passage;

a nozzle assembly mounted to the second end of said inner tube and said outer tube to direct fluid from the passage in the inner tube against the material to be excavated, while directing the high pressure fluid flow from the annular passage generally opposite the direction of the high pressure fluid flow exiting from the center passage of the inner tube to generate a force sufficient to convey excavated materials away from the excavation site for disposal.

8. The apparatus of claim 7 wherein the nozzle assembly is integral and comprises a body defining a shearing tip, and an evacuator skirt, the apparatus further comprising a jet nozzle threadedly received in the nozzle assembly, the second end of the outer tube being threaded, said nozzle assembly being threaded onto the threaded end of said outer tube, and the apparatus further comprising an O-ring positioned between said nozzle assembly and the outer surface of said inner tube.

9. The apparatus of claim 7 wherein said nozzle assembly includes a tapered inlet nozzle forming a portion of the second end of the inner tube and means for isolating the passages in the inner and outer tubes.

10. The apparatus of claim 7 wherein said nozzle assembly includes a nozzle secured to the second ends of said inner tube and said outer tube, said nozzle having an exterior section, a shearing tip removably attached to said exterior section of said nozzle and an evacuator skirt secured to the outer tube.

11. The apparatus of claim 7 wherein said apparatus further comprises a supply of an excavation enhancing material, a supply tube extending from said supply to said nozzle assembly, the nozzle assembly having an injector nozzle connecting said tube proximate the high velocity fluid outlet from the nozzle assembly to entrain the material in the high velocity flow.

12. The apparatus of claim 9 further comprising a shearing tip secured to the outer tube and an excavator skirt secured to the outer tube.

13. An apparatus for excavating material by use of high velocity air from a source of high velocity air, comprising:

a member having a first passage formed therein, the first passage having a first end connected to the high velocity air source, and a second end, said member further having a second passage formed therein, the second passage having a first end connected to the high velocity air source and a second end, said first and second passages being concentric;

a nozzle secured to the member at the second end of the first passage to direct high velocity air exiting from the first passage against the material to be excavated; and guide means mounted on the member proximate the excavated material for directing the high velocity air exiting from the second end of the second passage in a direction to drive the excavated material away from the site of excavation; and the nozzle having a bore formed therethrough connected to the first passage at the second end, said bore being tapered inwardly and then outwardly diverging to accelerate the high velocity air to supersonic speeds to exit from the first passage against the material to be excavated.

14. The apparatus of claim 13 wherein the apparatus excavates a borehole, said guide means directing the high velocity air exiting from the second end of the second passage in a direction generally opposite the direction of the high velocity air exiting from the second end of the first passage with the action of said air flow from the second passage within the confines of the borehole directing the material excavated from the borehole.

15. The apparatus of claim 13 further comprising a casing surrounding a portion of the member, the apparatus for excavating a borehole of predetermined diameter, the casing sized to maintain said predetermined diameter as the casing moves into the borehole with the member as the borehole is excavated, material removed from the excavation site by the high velocity air exiting from the second passage moving the material within the casing for removal.

16. A method for excavating material by use of air at high velocity from a high velocity air source, comprising the steps of:

accelerating the velocity of the air to supersonic speeds;

directing the discharge of supersonic speed air through as first passage in a member against as site to be excavated; and discharging high velocity air from a second passage in the member at the excavation site in a direction to drive material excavated from the excavation site away from the excavation site for disposal, the second passage being connected to the source of high velocity air independent of the first passage to deliver two sources of air to the excavation site.

17. The method of claim 16 further for forming a borehole of predetermined diameter, the method including the step of placing a casing having a tubular portion of the predetermined diameter about the member and moving the casing within the borehole as the member excavates the material, the casing controlling the dimensions of the borehole and the discharge of the material excavated by passing through the tubular portion out of the borehole for disposal.

* * * * *

UNITED STATES PATENT AND TRADEMARK OFFICE

CERTIFICATE OF CORRECTION

PATENT NO. : 5,212,891

DATED : May 25, 1993

INVENTOR(S) : Schuermann et al.

It is certified that error appears in the above-identified patent and that said Letters Patent is hereby corrected as shown below:

Column 2, Brief Description of the Drawings, line 58, insert --is a-- after the words --FIG. 22--.

Column 3, Detailed Description, line 37, delete --&:he-- and insert the word --the--.

Column 4, line 6, delete the word --ward-- and insert the word --wand--.

Column 5, line 54, delete the word --105A-- and insert the word --106A--.

Column 9, line 59, delete the word --tribe-- and insert the word --tube--.

Column 9, line 61, delete the --,-- after the word --do--.

Signed and Sealed this

Twenty-ninth Day of March, 1994

*Attest:*

Bruce Lehman

BRUCE LEHMAN

*Attesting Officer*

*Commissioner of Patents and Trademarks*